US010072652B2

(12) United States Patent
Roman et al.

(10) Patent No.: US 10,072,652 B2
(45) Date of Patent: Sep. 11, 2018

(54) RECIPROCATING POSITIVE DISPLACEMENT PUMP WITH ELECTRIC REVERSING MOTOR

(75) Inventors: Timothy S. Roman, Minnetonka, MN (US); Greg T. Mrozek, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 112 days.

(21) Appl. No.: 14/343,475

(22) PCT Filed: Sep. 10, 2012

(86) PCT No.: PCT/US2012/054471

§ 371 (c)(1),
(2), (4) Date: Mar. 7, 2014

(87) PCT Pub. No.: WO2013/036937

PCT Pub. Date: Mar. 14, 2013

(65) Prior Publication Data

US 2014/0219819 A1 Aug. 7, 2014

Related U.S. Application Data

(60) Provisional application No. 61/532,650, filed on Sep. 9, 2011.

(51) Int. Cl.

| | |
|---|---|
| ***F04B 49/12*** | (2006.01) |
| ***F04B 17/03*** | (2006.01) |
| ***F04B 49/06*** | (2006.01) |

(52) U.S. Cl.

CPC ..... *F04B 49/12* (2013.01); *F04B 17/03* (2013.01); *F04B 49/06* (2013.01); *F04B 2201/0201* (2013.01); *F04B 2203/0209* (2013.01)

(58) Field of Classification Search

CPC ..... F04B 17/03; F04B 19/22; F04B 49/06; F04B 49/123; F04B 49/125;

(Continued)

(56) References Cited

U.S. PATENT DOCUMENTS 1,984,296 A 12/1934 Witter
4,093,404 A * 6/1978 Soehngen et al. .. B01F 15/0454 417/317

(Continued)

FOREIGN PATENT DOCUMENTS

GB 2158617 A 11/1985
JP 49105118 A 10/1974

(Continued)

OTHER PUBLICATIONS

Author: Sergio A. Diaz Title: Sucker rod pump Date published (yyyy): 1999 Date accessed (mm/dd/yyyy): Jun. 10, 2016 Link: http://web.mit.edu/2.972/www/reports/sucker_rod_pump/sucker_rod_pump.html.*

(Continued)

*Primary Examiner* — Devon Kramer
*Assistant Examiner* — Chirag Jariwala
(74) *Attorney, Agent, or Firm* — Kinney & Lange, P.A.

(57) ABSTRACT

A pump system comprises an electric motor, a pump, a converter and a controller. The electric motor has a rotational output shaft that is rotatable in a first rotational direction and an opposite second rotational direction. The pump has a linearly displaceable input shaft that is movable in a first linear direction and an opposite second linear direction. The converter couples the output shaft to the input shaft such that rotation of the output shaft in the first rotational direction translates the input shaft in the first linear direction, and rotation of the output shaft in the second rotational direction translates the input shaft in the second (Continued)

linear direction. The controller repeatedly reverses rotation of the output shaft to produce reciprocating motion of the input shaft.

30 Claims, 5 Drawing Sheets

(58) Field of Classification Search
CPC ..... F04B 2203/02; F04B 2203/0201; F04B 2203/0202; F04B 2203/0207; F04B 2201/0206; F04B 2201/02071; F04B 2201/0209; F04B 2201/0212; F04B 49/12; F04B 2201/02
USPC ..... 417/410.1, 44.1, 45, 218, 223, 12
See application file for complete search history.

(56) References Cited

U.S. PATENT DOCUMENTS 5,284,423 A 2/1994 Holdsworth et al.
5,725,358 A * 3/1998 Bert et al. ..... F04B 13/00 417/415
6,577,089 B1 * 6/2003 Piedl et al. ..... F04B 49/065 318/432
6,679,105 B1 * 1/2004 Jepsen ..... G01N 11/00 73/86
6,957,747 B2 10/2005 Peeler et al.
2007/0041845 A1 * 2/2007 Freudenberger ..... F04B 13/00 417/63
2007/0276544 A1 * 11/2007 Dainez ..... F04B 35/045 700/281
2011/0132463 A1 * 6/2011 Witt ..... F04B 11/0058 137/1

FOREIGN PATENT DOCUMENTS

JP 58045979 A 3/1983
JP 01104989 A 4/1989
WO WO 9012962 A1 * 11/1990 ..... F04B 43/04

OTHER PUBLICATIONS

European Search Report, EP Application Serial No. 112829956, dated Jun. 30, 2015, 8 pages.
State Intellectual Property Office of People's Republic of China, First Office Action, Application No. 201280043742.1, dated Jul. 24, 2015, 2 pages.
International Search Report and Written Opinion, dated Feb. 21, 2013.
Russian Office Action, for Russian Patent Application No. 2014113456/06, dated Aug. 25, 2016, 10 pages.
Third Chinese Office Action, for Chinese Patent Application No. 201280043742.1, dated Sep. 26, 2016, 19 pages.
English Translation of Japanese Office Action, for Japanese Patent Application No. 2014-529947, dated Jul. 29, 2016, 11 pages.
Communication Pursuant to Article 94(3) EPC from EP Application No. 12829956.7, dated Apr. 5, 2018, 4 pages.

* cited by examiner

RECIPROCATING POSITIVE DISPLACEMENT PUMP WITH ELECTRIC REVERSING MOTOR

CROSS-REFERENCE TO RELATED APPLICATION(S)

This Patent Application is a Non-provisional Patent Application of Provisional Patent Application No. 61/532,650, filed Sep. 9, 2011 and claims priority of PCT Application No. PCT/US2012/054471, filed Sep. 10, 2012. All references are incorporated herein.

BACKGROUND

The present disclosure relates generally to positive displacement pump systems. More particularly, the present disclosure relates to drive systems for reciprocating pumps and methods for controlling reciprocation.

Positive displacement pumps comprise systems in which a fixed volume of material is drawn into an expanding chamber and pushed out of the chamber as it contracts. Such pumps typically comprise a reciprocating pumping mechanism, such as a piston, or a rotary pumping mechanism, such as a gear set. Reciprocating piston pumps, therefore, require a bi-directional input that can drive the piston to expand and collapse the pumping chamber. Typical pumping systems are driven by a rotary input, such as a motor with a rotating output shaft. The motors are conventionally configured as air motors powered by compressed air or electric motors powered by alternating current. Rotary inputs, thus, require the uni-directional rotation of the output shaft to be converted into a reciprocating motion. This is conventionally achieved by the use of crankshaft or cam systems, such as is described in U.S. Pat. No. 5,145,339 to Lehrke et al., which is assigned to Graco Inc. Air motors are inefficient in energy consumption due to the need for a motor to drive the compressor, conversion of the compressed air into rotary motion and conversion of the rotary motion to reciprocating motion. Furthermore, air motors and the compressors that power them produce undesirable amounts of noise and can experience issues relating to icing due to the contraction and expansion of the air. Electric motors achieve energy efficiency over air motors, but still require complicated mechanical devices for converting the uni-directional rotation into bi-directional, reciprocating linear motion for the pump. There is, therefore, a need for improved drive systems for reciprocating positive displacement pumps.

SUMMARY

A pump system comprises an electric motor, a pump, a converter and a controller. The electric motor has a rotational output shaft that is rotatable in a first rotational direction and an opposite second rotational direction. The pump has a linearly displaceable input shaft that is movable in a first linear direction and an opposite second linear direction. The converter couples the output shaft to the input shaft such that rotation of the output shaft in the first rotational direction translates the input shaft in the first linear direction, and rotation of the output shaft in the second rotational direction translates the input shaft in the second linear direction. The controller repeatedly reverses rotation of the output shaft to produce reciprocating motion of the input shaft.

A method of operating a pump comprises repeatedly reversing current flow direction to an electric motor to cause alternating rotation of an output shaft of the motor in clockwise and counterclockwise directions, and converting the alternating rotation of the output shaft to reciprocating linear motion of a pump shaft.

DETAILED DESCRIPTION

Figure 1:
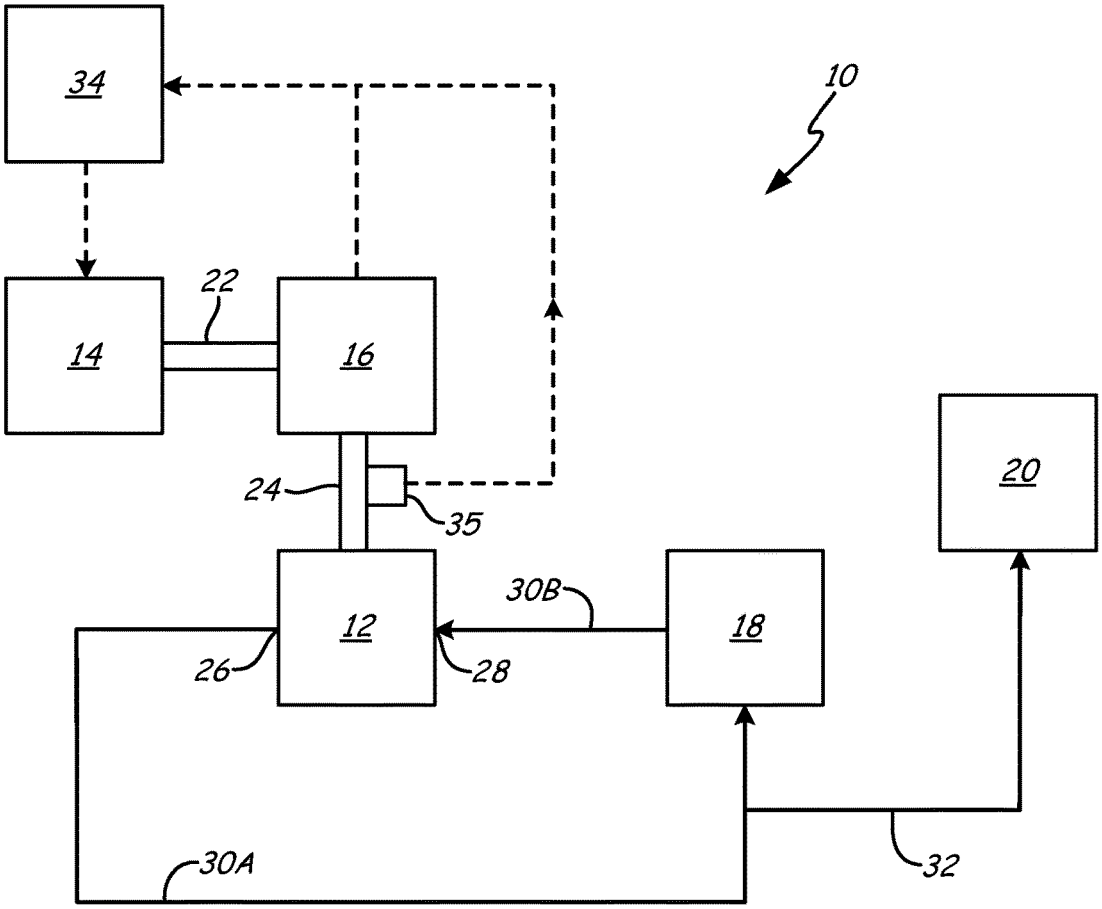
FIG. 1 is a schematic of a pumping system having a positive displacement pump driven by a bi-directional electric motor through a motion converter.

FIG. 1 is a schematic view of pumping system 10 having positive displacement pump 12 driven by electric motor 14 and motion converter 16. Pump 12 draws a fluid, such as paint, from reservoir 18 and delivers pressurized fluid to sprayer 20. Fluid unconsumed by sprayer 20 is returned to reservoir 18. Drive shaft 22 of motor 14 and pump shaft 24 of pump 12 are mechanically coupled to converter 16. Converter 16 produces positive displacement of pump shaft 24 from rotation of drive shaft 22. Outlet 26 and inlet 28 of pump 12 are connected to reservoir 18 via fluid lines 30A and 30B, respectively. Sprayer 20 is coupled to fluid line 30A by hose 32. Motor 14 is electronically controlled by controller 34, which includes position sensor 35.

Electric motor 14 is provided with a power supply from controller 34 to provide motive force to drive shaft 22. In the disclosed embodiment, motor 14 comprises a rotary motor in which shaft 22 rotates about a central axis. Controller 34 is electrically coupled to motor 14 to control the current provided to motor 14, thereby controlling the rotation of shaft 22. In the embodiment described with reference to FIGS. 2-4, motor 14 comprises a brushless, direct current (DC) electric motor. However, motor 14 may comprise a brush DC motor or a permanent magnet alternating current (AC) motor.

Rotation of shaft 22 turns a conversion mechanism within converter 16. Converter 16 changes the rotational movement of shaft 22 into a linear movement of shaft 24. Specifically, converter 16 converts uni-directional rotation of shaft 22 into displacement of shaft 24 in a single direction. In the embodiment described with reference to FIGS. 2-4, converter 16 comprises a rack and pinion system wherein shaft 22 rotates a pinion gear that intermeshes with a linear gear rack coupled to pump shaft 24. Converter 16 typically also includes a gear reduction system that, for example, reduces the speed of pump shaft 24 relative to drive shaft 22. However, converter 16 may comprise other types of conversion systems, such as a cam system or crank system.

Converter 16 is coupled to pump shaft 24 of pump 12. Pump 12 comprises a positive displacement pump wherein reciprocation of shaft 24 expands and contracts a pumping chamber. In the embodiment described with reference to FIGS. 2-4, pump 12 comprises a linear displacement piston pump wherein a piston is disposed in a cylinder to draw fluid into inlet 28 and to push compressed fluid from outlet 26. However, pump 12 may comprise other types of positive displacement pumps, such as a diaphragm pump.

Pressurized fluid leaves pump outlet 26. Pressurized fluid is forced through fluid line 30A to reservoir 18. Pump 12 draws in unpressurized fluid from reservoir 18 through fluid line 30B and inlet 28 by the pumping mechanism of pump 12. Sprayer 20 is connected in parallel with reservoir 18 to draw pressurized fluid from fluid line 30A. Sprayer 20 is selectively operated to dispense the fluid of reservoir 18. Sprayer 20 can be directly manually operated or can be operated by a controller as part of an automated spray process.

In the present invention, system 10 utilizes a reversible electric motor, such as brushless DC motor 14, that powers a linear actuator, such as converter 16, for driving a reciprocating pump, such as piston pump 12. In embodiments utilizing a brushless DC motor, controller 34 operates to provide reversing current to motor 14 to generate the reciprocating motion. More specifically, controller 34 reverses the direction of flow of the current across motor 14 to produce a change in the rotational direction of shaft 22. Brushless DC motors have low inertia and can reverse directions in rapid response to a change in current flow direction. Furthermore, brushless DC motors provide a full range of torque at zero speed, thereby enabling pump 12 to maintain full pressure, which mimics the response of a pneumatic motor without the noise, expense and ice issues. Brushless DC motors also have a direct relationship between applied current and shaft torque. Thus, only the speed of motor 14 will change as the constant torque (and current) output of motor 14 maintains constant pressure output at pump 12. Furthermore, in another aspect of the present invention, controller 34 utilizes position sensor 35 to monitor the position of pump shaft 24 such that reversal of pump 12 can be randomized or varied to reduce wear of internal components of system 10.

Figure 2:
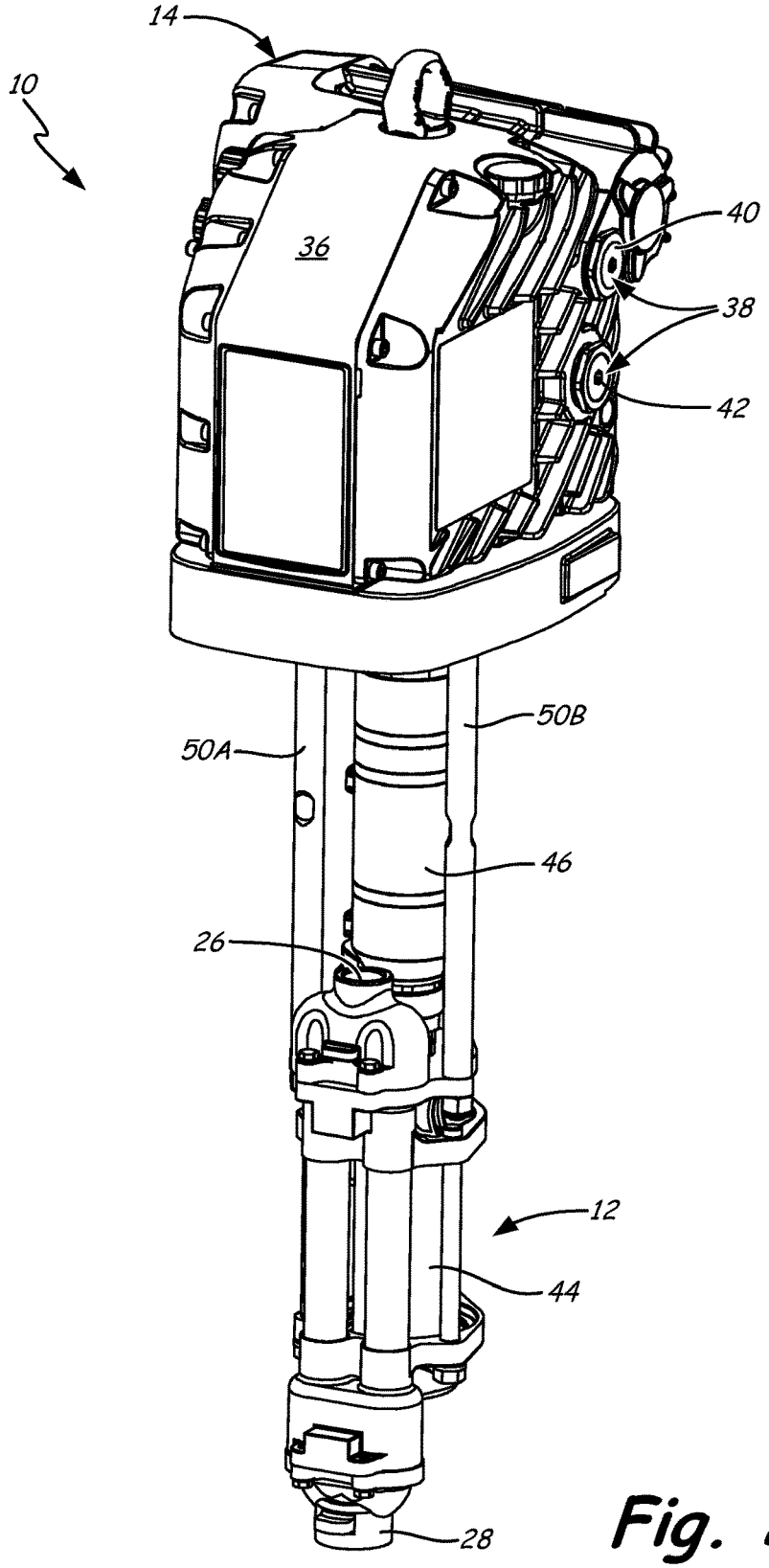
FIG. 2 is a perspective view of a pumping system according to the configuration of FIG. 1 wherein a linear displacement piston pump is driven by a brushless DC motor.
Figure 3:
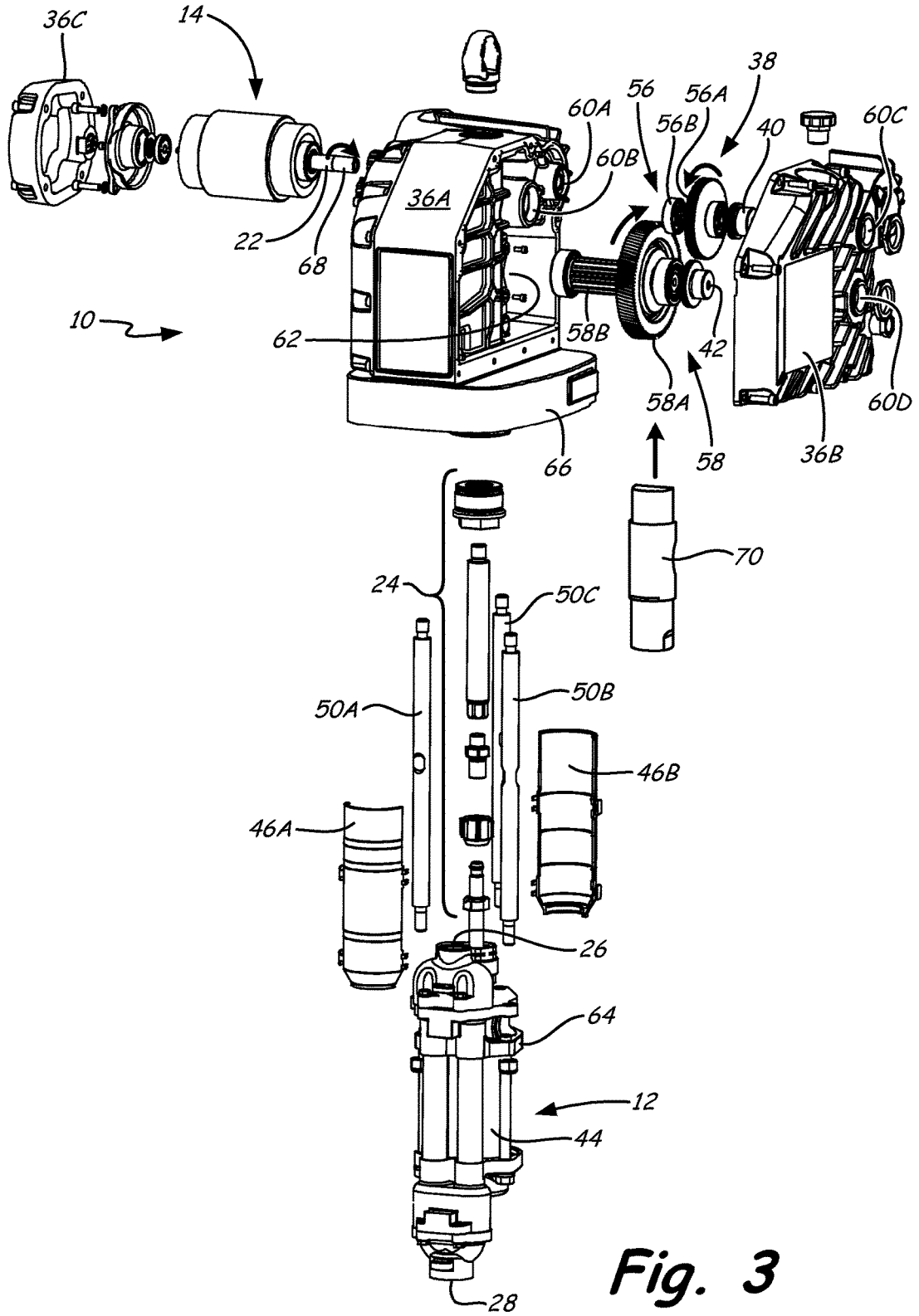
FIG. 3 is an exploded view of the pumping system of FIG. 2 showing a gear reduction system for coupling an output shaft of the brushless DC motor to an input shaft of the linear displacement piston pump.

FIG. 2 is a perspective view of pumping system 10 according to the configuration of FIG. 1 wherein linear displacement piston pump 12 is driven by brushless DC motor 14. Pump 12 and motor 14 are enclosed in housing 36, which also encases motion converter 16 (not shown). Converter 16 includes gear reduction system 38, which is mounted within housing 36. Gear reduction system 38, which includes shafts 40 and 42, connects a pinion gear of motor 14 to a rack gear of pump 12. Pump 12 includes inlet 28, outlet 26, piston cylinder 44 and shaft shield 46, which encases an input shaft (FIG. 3) for pump 12. Pump 12 is assembled to housing 36 via tie rods 50A, 50B and 50C (FIG. 3). Tie rods 50A-50C hold pump 12 fixed relative to housing 36 such that pump shaft 24 within shield 46 can be actuated by motor 14 through converter 16 and gear reduction system 38.

FIG. 3 is an exploded view of pumping system 10 of FIG. 2 showing gear reduction system 38 for coupling drive shaft 22 of brushless DC motor 14 to pump shaft 24 of linear displacement piston pump 12. Converter 16 (FIG. 1) encompasses gear reduction system 38, which includes first gear set 56 and second gear set 58. Housing 36 includes main housing 36A, gear cover 36B and motor cover 36C.

Motor 14 is inserted into a cavity within main housing 36A such that drive shaft 22 extends through opening 60A to provide an output shaft for driving gear reduction system 38. Motor cover 36C is positioned against main housing 36A to enclose motor 14. Shaft 40 of first gear set 56 is secured between opening 60B in main housing 36A and opening 60C in gear cover 36B. Shaft 42 of second gear set 58 is secured to opening 60D in gear cover 36B and extends into cavity 62 of main housing 36A. Pump shaft 24 provides an input shaft for operation of pump 12. A first end of pump shaft 24 of pump 12 extends into cavity 62 of main housing 36A and is coupled to second gear set 58 through a rack gear (see rack gear 70 in FIG. 4). A second end of pump shaft 24 extends through shield 46 into piston cylinder 44 to actuate a piston (not shown). Tie rods 50A-50C connect platform 64 of pump 12 to base 66 of main housing 36A. Shield pieces 46A and 46B are positioned around pump shaft 24 between tie rods 50A-50C. Input 28 of pump 12 couples to a source of unpressurized fluid, such as fluid line 30B (FIG. 1). Outlet 26 of pump 12 couples to a fluid dispenser, such as sprayer 20 (FIG. 1).

In one embodiment, motor 14 is mounted within housing 32 such that drive shaft 22 is perpendicular to pump shaft 24. For example, system 10 is intended to be operated atop a flat surface, such as a floor. Pump shaft 24 is configured to be generally perpendicular to the flat surface. Motor 14 is thereby typically mounted perpendicular to shaft 24 and parallel with the flat surface. As such, rotation of shaft 22 can be easily converted to up-and-down, linear translation of shaft 24, such as by use of a rack and pinion system. Motor 14 rotates drive shaft 22, which provides rotation to first gear set 56. First gear set 56 causes rotation of second gear set 58, which causes movement of pump shaft 24 of pump 12 through the rack gear (not shown). Pump shaft 24 drives the piston within cylinder 44 to draw unpressurized fluid into inlet 28 and to push pressurized fluid out outlet 26. In one embodiment of the invention, pump 12 comprises a 4-ball piston pump as is commercially available from Graco Inc. An example of a 4-ball piston pump is generally described in U.S. Pat. No. 5,368,424 to Powers, which is assigned to Graco Inc. Shield pieces 46A and 46B, among other things, protect dirt, dust and debris from entering into pump cylinder 44 through the access opening for pump shaft 24. Tie-rods 50A-50C rigidly maintain pump 12 spaced from housing 36 such that converter 16, including gear reduction system 38, can reciprocate pump shaft 24 relative to cylinder 44. Tie-rods 50A-50C thereby react forces generated by motor 14 and applied to pump 12.

When assembled, gear reduction system 38 provides a power transmitting coupling between pinion gear 68 of drive shaft 22 and rack gear 70 (FIG. 4) of pump shaft 24. Specifically, pinion gear 68 connects to input gear 56A of gear set 56. Output gear 56B connects to input gear 58A of gear set 58, which drives output gear 58B. Output gear 58B provides rotational input to rack gear 70. As such, rotation of shaft 22 by motor 14 causes linear displacement of shaft 24. Converter 16, including gear reduction system 38, provides only a one-way transmission of force from shaft 22 to shaft 24 such that a single direction of movement of shaft 24 correlates to a single direction of rotation of shaft 22. The direction of rotation of shaft 22 by motor 14 is reversed by controller 34 (FIG. 1) to cause repeated reciprocation of shaft 24 to provide pumping action of the piston within cylinder 44.

Figure 4:
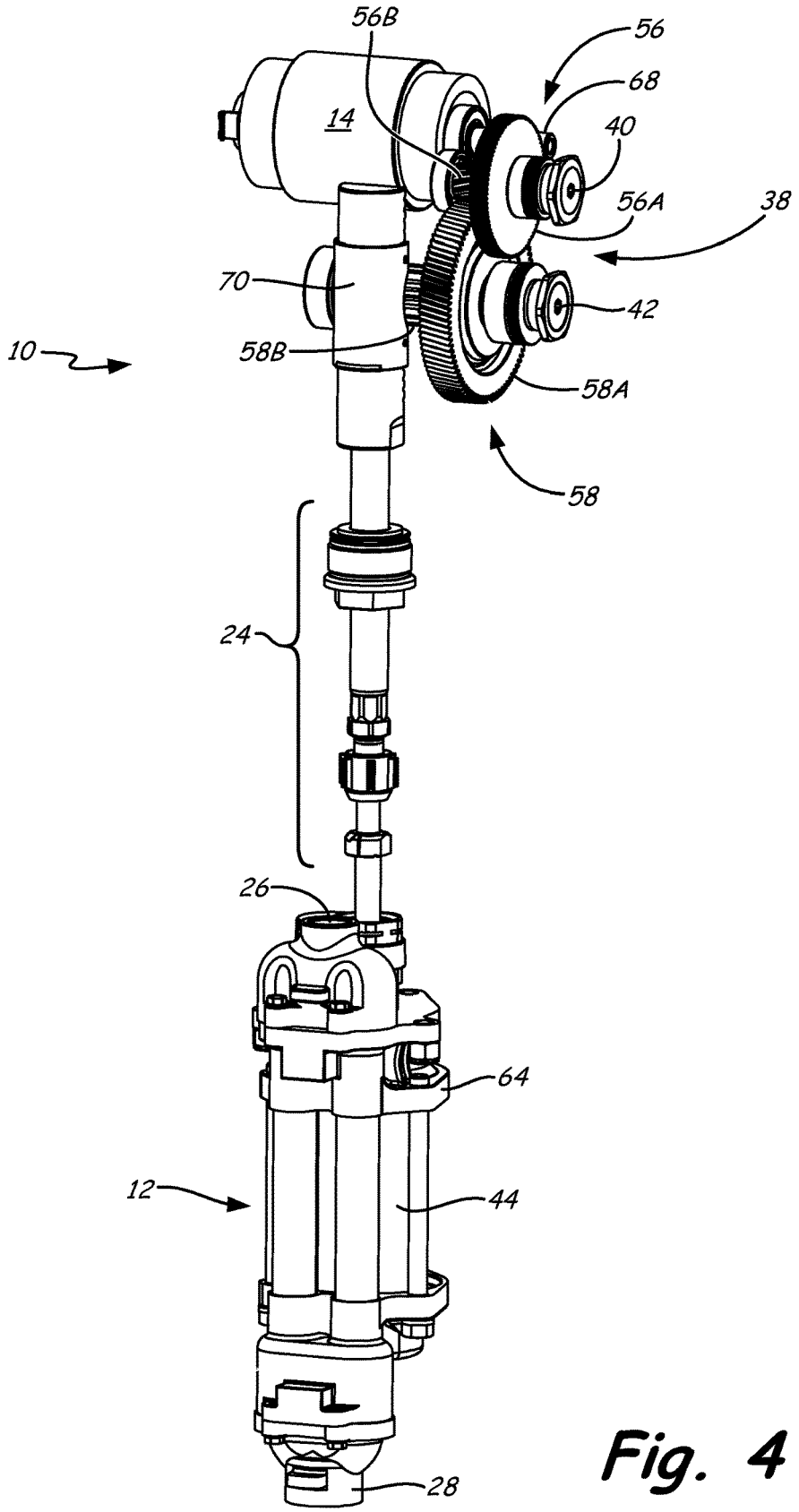
FIG. 4 is a perspective view of the pumping system of FIG. 3 showing a pinion gear of the output shaft and a rack gear of the input shaft linked by the gear reduction system.

FIG. 4 is a perspective view of pumping system 10 of FIG. 3 showing pinion gear 68 of drive shaft 22 (FIG. 3) and rack gear 70 of pump shaft 24 linked by gear reduction system 38. Housing 36 is not shown in FIG. 4 so that assembly of the components of pumping system 10 can be seen. Rotation of drive shaft 22 by motor 14 causes translation of pump shaft 24 of pump 12. Motor 14 is provided with a reversing-flow of DC current from controller 34 (FIG. 1) to cause alternating, two-way or bi-directional rotation of drive shaft 22.

For a first period of time, a first directional flow of DC current is provided to motor 14 to cause rotation of shaft 22 in a clockwise direction, which will ultimately cause pump shaft 24 of pump 12 to move upward with respect to FIG. 4. Rotation of pinion gear 68 in the clockwise direction causes rotation of input gear 56A in the counterclockwise direction. Input gear 56A rotates at a slower rate due to the larger diameter of gear 56A compared to that of pinion gear 68. Input gear 56A and output gear 56B are mounted on shaft 40 such that output gear 56B rotates in the counterclockwise direction at the same rate as input gear 56A. Output gear 56B is meshed with input gear 58A of second gear set 58 such that counterclockwise rotation of output gear 56B causes clockwise rotation of input gear 58A. Input gear 58A has a larger diameter than output gear 56B such that input gear 58A rotates at a slower rate than output gear 56B. Input gear 58A and output gear 58B are mounted on shaft 42 such that output gear 58B rotates in the clockwise direction at the same rate as input gear 58A. As such, the clockwise rotational speed of output gear 58B is reduced as compared to the clockwise rotational speed of pinion gear 68. The particular speed reduction depends on the specific parameters of motor 14 and pump 12 and the desired output of system 10. Output gear 58B rotates clockwise to push rack gear 70 upward with reference to the orientation of FIG. 4.

Upward movement of rack gear 70 also forces pump shaft 24 upward. The distance that pump shaft 24 moves upward correlates directly to the period of time that controller 34 causes motor 14 to rotate shaft 22 in the first direction. Thus, the stroke length of pump shaft 24, or the piston within cylinder 44, directly corresponds to the length of time current is provided to motor 14 in a given direction. Shaft 24 moves outward away from pump 12 to draw fluid into cylinder 44 at inlet 28.

In order to reinsert shaft 24 into cylinder 44 and push pressurized fluid out of cylinder 44 at outlet 26, controller 34 causes motor 14 to reverse the direction of rotation of shaft 22 to a second direction opposite that of the first direction. In one embodiment, controller 34 reverses the directional flow of current through motor 14. Such can be accomplished by reversing the polarity of the current at the armatures of motor 14, as is known in the art. Thus, rack gear 70 is pushed downward (with reference to FIG. 4) through interaction of first gear set 56 and second gear set 58, which causes pump shaft 24 to be pushed into cylinder 44. Linear reciprocation of pump shaft 24 is thus achieved by alternating continuous flows of current in opposite directions across motor 14 for periods of time, which is commanded by controller 34 (FIG. 1).

Control parameters for motor 14 are set by an operator of system 10 based on the desired output of pump 12. As such, controller 34 comprises a computer system including a processor, memory, graphical display, user interfaces, memory and the like, as are known in the art. The magnitude of the current provided to motor 14, the alternating of the polarity (direction) of the current, and the length of time each polarity of current is applied to motor 14 is dictated by controller 34 (FIG. 1). Controller 34 operates to maintain a steady magnitude of current to motor 14 at each polarity. Constant current results in motor 14 providing a constant torque output. Torque from drive shaft 22 is transmitted directly to pump shaft 24 in a linear relationship by pinion gear 68, gear reduction system 38 and rack gear 70. The speed of drive shaft 22 is thus dictated by the force reacted against drive shaft 22 from pressures within pump 12 through gear reduction system 38. As discussed above, brushless DC motors respond quickly to changes in input current, which allows for motor 14 to rapidly reverse direction, physically stopping rotation (where velocity is equal to zero) for a brief moment in between, while maintaining the torque output throughout. Thus, brushless DC motors can be manipulated by controller 34 to reciprocate movement of pump shaft 24 without the need for elaborate mechanical devices for converting rotation of an output shaft into bi-directional, reciprocating translation of a pump shaft. Further, brushless DC motors are quieter and utilize less power than prior art air motors. As such, pumping system 10 decreases noise output and improves operating costs as compared to other systems.

Figure 5A:
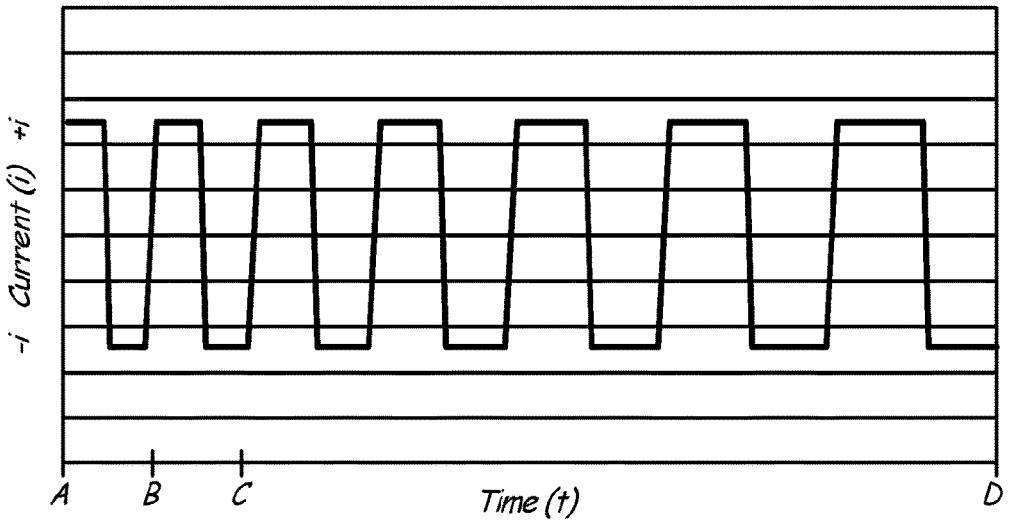
FIG. 5A is a graph showing input current polarity to the brushless DC motor of FIGS. 2-4 versus time.
Figure 5B:
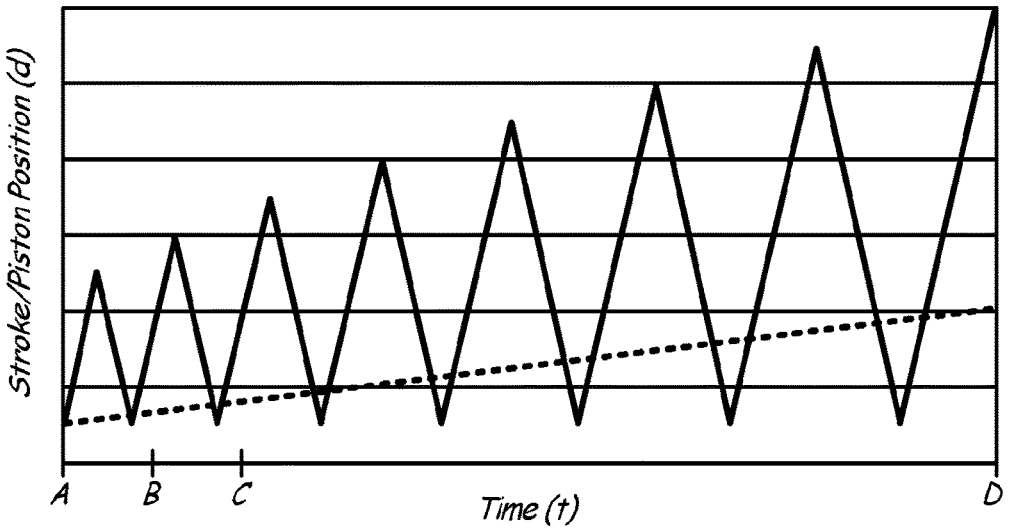
FIG. 5B is a graph showing stroke of the pump shaft of the linear displacement piston pump of FIGS. 2-4 versus time.

FIG. 5A is a graph showing input current (i) to brushless DC motor 14 of FIGS. 2-4 versus time (t). FIG. 5B is a graph showing stroke (d) of pump shaft 24 of linear displacement piston pump 12 of FIGS. 2-4 versus time (t). With reference to FIG. 5A, the magnitude of current i is approximately equal at all points in time. Thus, torque output of shaft 22 is approximately constant. For example, at time A, controller 34 operates to provide a positive flow of current flow through motor 14, which, depending on gearing, causes an upward movement of pump shaft 24. Subsequently, controller 34 operates to instantly provide a negative flow of current flow across motor 14 having an equal magnitude as the positive polarity. Such a reversal produces downward movement of pump shaft 24. Thus, between time A and time B one complete pump reversal cycle occurs. The directional flow of current i is continuously alternated between positive and negative flow for periods of time to cause continuous reciprocation of pump shaft 24 as long as is desired.

A pump reversal cycle comprising an upward stroke and a downward stroke of pump shaft 24 is completed by a pair of positive and negative current polarities. The amount of time over which each pump reversal cycle takes place may change to achieve benefits in the performance of system 10, as described below. In the depicted embodiment, each positive polarity and negative polarity increases over the period of time shown. Thus, a second pump reversal occurs between time B and time C and is longer than the first pump reversal between time A and time B. Each subsequent pump reversal increases in time over the previous pump reversal. This corresponds to pump shaft 24 traversing a greater linear length, increasing the stroke length of the piston in cylinder 44, as shown in FIG. 5B. These variations in the stroke length cause pump shaft 24 to reverse direction at different intermeshing positions of the gears within gear reduction system 38, pinion gear 68 and rack gear 70 thereby improving wear distribution in the gearing.

With reference to FIG. 5B, for the solid line shown, the position d of the piston within cylinder 44 is shown increasing in magnitude from time A to time D. For example, between time A and time B, stroke d increases to a particular position and then retreats back to the starting position. Each subsequent pump reversal increases the stroke d over the previous. Thus, time A to time B of FIG. 5A corresponds to the same timeframe in FIG. 5B, showing the stroke length increasing. After the stroke length is increased so as to utilize all or most of cylinder 44 at time D, the stroke length can be progressively decreased. Time A to time B of FIGS. 5A and 5B can thus be mirror imaged along a vertical axis at time D to progressively shorten the current intervals and stroke length.

The benefits of varying the stroke length include increasing the wear life of pumping system 10. In particular, the wear lives of the gears of converter 16 are increased. Pump reversals induce shock loading in the gear teeth, particularly in pinion gear 68. This is particularly so when pump reversal time is minimized and drive shaft 22 is rapidly reversing direction. Varying the stroke length of pump shaft 24 changes which gear teeth are engaged when reversal occurs, thereby distributing the shock loading amongst a greater number of gear teeth. Furthermore, the positions along bearing contact regions within pumping system 10, such as along shaft 24, shaft 40 or shaft 42, at which pump reversal occurs will be varied, thereby increasing the wear life of bearings within system 10.

The solid line plots of FIGS. 5A and 5B show a linear, uniform variation in the stroke length over a predetermined pattern. As can be seen in FIG. 5A, between time A and time B a complete pump reversal has occurred. Each reversal period of time is divided equally between a positive current flow and negative current flow. Such equal distribution ensures that pump shaft 24 does not cause the piston within cylinder 44 to end-out or impact the end of the cylinder so as to not have enough room to complete a programmed pump stroke. However, the stroke length can be randomly varied or can be varied over a non-uniform pattern. The time distribution for the positive and negative polarities within each pump reversal can be varied so long as controller 34 monitors the absolute position of the piston or is provided with a program pattern that avoids ending-out of the piston in the cylinder. As such, controller 34 utilizes position sensor 35 to monitor the absolute position of pump shaft 24 with reference to cylinder 44. Alternatively, cylinder 44 can be provided with a position sensor to monitor the position of the piston.

The solid line in FIG. 5B shows, as an example, changing from an up-stroke to a down-stroke at varying positions (indicated by the tips of the peaks), but the change from a down-stroke to an up-stroke always occurs at the same original position (indicated by the valleys at the zero axis). The dashed line, however, shows that the change from the down-stroke to the up-stroke can occur at different positions. The stroke length is thus maintained within the overall available space of cylinder 44 at all times, but the position where each stroke change-over occurs can change. Thus, not only can the magnitude of the stroke length be made to vary, but the position at which the stroke change-over occurs, with respect to the position of shaft 24 relative to cylinder 44 (and the engagement of teeth of the gearing in converter 16), can be made to vary.

Although the present invention has been described with reference to preferred embodiments, workers skilled in the art will recognize that changes may be made in form and detail without departing from the spirit and scope of the invention.

The invention claimed is:

1. A pump system comprising:

an electric motor having an output shaft that is reversibly rotatable in a first rotational direction and an opposite second rotational direction;

a pump having an input shaft that is movable in a first linear direction and an opposite second linear direction;

a rack and pinion converter coupling the output shaft to the input shaft such that:

rotation of the output shaft in the first rotational direction translates the input shaft in the first linear direction;

rotation of the output shaft in the second rotational direction translates the input shaft in the second linear direction; and a controller that repeatedly reverses rotation of the output shaft to produce reciprocating motion of the input shaft; and wherein the controller reverses current flow direction of current provided to the electric motor to reverse rotation of the output shaft and wherein the controller progressively increases a magnitude of a stroke length of the pump shaft to a maximum stroke length and then progressively decreases the magnitude of the stroke length to a minimum stroke length to vary which gear teeth of the rack and pinion system converter are engaged when rotation reversal occurs so that shock loading is distributed over time among a number of different gear teeth.

2. The pump system of claim 1 wherein the pump comprises a positive displacement pump.

3. The pump system of claim 1 wherein the converter further comprises a gear reduction system.

4. The pump system of claim 3 wherein the gear reduction system comprises a two-stage speed reducing system.

5. The pump system of claim 1 further comprising:

wherein the electric motor comprises a brushless direct current motor.

6. The pump system of claim 5 wherein the controller maintains a constant torque output of the electric motor.

7. The pump system of claim 5 wherein the controller varies time between current flow direction reversals from one reversal to the next.

8. A method of operating a pump, the method comprising:

repeatedly reversing current flow direction to an electric motor to cause alternating rotation of an output shaft of the motor in clockwise and counterclockwise directions wherein:

rotation of the output shaft in the clockwise direction produces linear movement of the pump shaft in a first direction; and rotation of the output shaft in the counterclockwise direction produces linear movement of the pump shaft in a second, opposite direction; and converting the alternating rotation of the output shaft to reciprocating linear motion of a pump shaft, wherein converting the alternating rotation of the output shaft to reciprocating linear motion of the pump shaft comprises:

rotating a pinion gear with the output shaft; and translating a rack gear with the pinion gear;

varying which gear teeth of the rack gear and the pinion gear are engaged when rotation reversal occurs so that shock loading is distributed over time among a number of different gear teeth, by one of:

varying a time interval between current flow direction reversals to achieve at least one of an upper piston position limit or a decrease of a lower piston position limit; or varying a change-over position of the pump shaft where the pump shaft reverses linear translation; or progressively increasing a magnitude of a stroke length of the pump shaft to a maximum stroke length and then progressively decreasing the magnitude of the stroke length to a minimum stroke length.

9. The method of claim 8 wherein:

the electric motor comprises a brushless direct current motor; and the pump comprises a positive displacement pump.

10. The method of claim 8 further comprising:

supplying a constant flow of current to the electric motor to maintain a constant torque; and maintaining a constant pressure output at the pump.

11. The method of claim 8 wherein the time between current flow direction reversals is varied in a non-uniform pattern.

12. A pump system comprising:

a brushless direct current electric motor having a rotational output shaft;

a positive displacement pump having a linearly displaceable input shaft;

a rack and pinion conversion system coupling the output shaft to the input shaft such that clockwise rotation of the output shaft translates the input shaft in a first direction and counterclockwise rotation of the output shaft translates the input shaft in a second direction that is opposite to the first direction; and a controller that repeatedly reverses rotation direction of the output shaft to produce reciprocating translation of the input shaft, and wherein the controller varies stroke length of the pump shaft to vary which gear teeth of the rack and pinion conversion system are engaged when rotation reversal occurs so that shock loading is distributed over time among a number of different gear teeth.

13. The pump system of claim 12 wherein the rack and pinion conversion system comprises:

a pinion gear coupled to the output shaft;

a rack gear coupled to the input shaft; and a gear reduction system coupled to the pinion gear and the rack gear.

14. A pump system comprising:

an electric motor having an output shaft that is reversibly rotatable in a first rotational direction and an opposite second rotational direction;

a pump having an input shaft that is movable in a first linear direction and an opposite second linear direction;

a rack and pinion converter coupling the output shaft to the input shaft such that:

rotation of the output shaft in the first rotational direction translates the input shaft in the first linear direction;

rotation of the output shaft in the second rotational direction translates the input shaft in the second linear direction; and a controller that repeatedly reverses rotation of the output shaft to produce reciprocating motion of the input shaft; and wherein the controller reverses current flow direction of current provided to the electric motor to reverse rotation of the output shaft and wherein the controller varies a time interval between current flow direction reversals to vary which gear teeth of the rack and pinion converter are engaged when rotation reversal occurs so that shock loading is distributed over time among a number of different gear teeth.

15. The pump system of claim 14 wherein the pump comprises a positive displacement pump.

16. The pump system of claim 14 wherein the converter further comprises a gear reduction system.

17. The pump system of claim 16 wherein the gear reduction system comprises a two-stage speed reducing system.

18. The pump system of claim 14 further comprising:

wherein the electric motor comprises a brushless direct current motor.

19. The pump system of claim 18 wherein the controller maintains a constant torque output of the electric motor.

20. A method of operating a pump, the method comprising:

repeatedly reversing current flow direction to an electric motor to cause alternating rotation of an output shaft of the motor in clockwise and counterclockwise directions; and converting the alternating rotation of the output shaft to reciprocating linear motion of a pump shaft through a gear reduction and rack and pinion gear system;

varying a time interval between current flow direction reversals to vary at least one of an upper piston position limit, or a lower piston position limit, or a pinion stroke length, so that different gear teeth of the gear reduction and rack and pinion system are engaged when rotation reversals of the output shaft occur and shock loading is distributed over time among a number of different gear teeth.

21. The method of claim 20 wherein:

rotation of the output shaft in the clockwise direction produces linear movement of the pump shaft in a first direction; and rotation of the output shaft in the counterclockwise direction produces linear movement of the pump shaft in a second, opposite direction.

22. The method of claim 20 further comprising:

supplying a constant flow of current to the electric motor to maintain a constant torque; and maintaining a constant pressure output at the pump.

23. The method of claim 20 wherein the time between current flow direction reversals is varied in a non-uniform pattern to reduce wear on components of the pump.

24. The method of claim 20 further comprising:

progressively increasing a magnitude of a stroke length of the pump shaft to a maximum stroke length and then progressively decreasing the stroke length to a minimum stroke length.

25. The method of claim 20 wherein:

the electric motor comprises a brushless direct current motor; and the pump comprises a positive displacement pump.

26. The method of claim 25 wherein converting the alternating rotation of the output shaft to reciprocating linear motion of the pump shaft comprises:

rotating a pinion gear with the output shaft; and translating a rack gear with the pinion gear.

27. The method of claim 20 wherein the time between current flow direction reversals varies over a pre-determined pattern.

28. The method of claim 27 wherein the time between current flow direction reversals achieves one of a progressive increase in the upper piston position limit and a progressive decrease in the lower piston position limit.

29. A pump system comprising:

a brushless direct current electric motor having a rotational output shaft;

a positive displacement pump having a linearly displaceable input shaft;

a rack and pinion conversion system coupling the output shaft to the input shaft such that clockwise rotation of the output shaft translates the input shaft in a first direction and counterclockwise rotation of the output shaft translates the input shaft in a second direction that is opposite to the first direction; and a controller that repeatedly reverses rotation direction of the output shaft to produce reciprocating translation of the input shaft, and wherein the controller varies a time interval between current flow direction reversals to reduce wear on gear teeth of the rack and pinion conversion system by varying which gear teeth are engaged when reversals of rotation direction of the output shaft occur.

30. The pump system of claim 29 wherein the rack and pinion conversion system comprises:

a pinion gear coupled to the output shaft;

a rack gear coupled to the input shaft; and a gear reduction system coupled to the pinion gear and the rack gear.

* * * * *